United States Patent [19]

Carey, Jr.

[11] Patent Number: 4,551,378

[45] Date of Patent: Nov. 5, 1985

[54] NONWOVEN THERMAL INSULATING STRETCH FABRIC AND METHOD FOR PRODUCING SAME

[75] Inventor: Patrick H. Carey, Jr., Bloomington, Minn.

[73] Assignee: Minnesota Mining and Manufacturing Company, St. Paul, Minn.

[21] Appl. No.: 629,770

[22] Filed: Jul. 11, 1984

[51] Int. Cl.[4] ..... D04H 1/06; D04H 1/54

[52] U.S. Cl. ..... 428/198; 156/62.4; 156/62.6; 156/308.2; 264/115; 264/123; 428/288; 428/296; 428/360; 428/362

[58] Field of Search ..... 456/62.4, 62.6, 308.2; 264/123, 115; 428/198, 288, 296, 360, 362

[56] References Cited

U.S. PATENT DOCUMENTS

| | | | |
|---|---|---|---|
| 3,589,956 | 6/1971 | Kranz et al. | 156/62.4 |
| 3,950,587 | 4/1976 | Colijin et al. | 428/234 |
| 4,068,036 | 1/1978 | Stanistreet | 428/296 |
| 4,189,338 | 2/1980 | Ejima et al. | 156/167 |
| 4,323,626 | 4/1982 | Kunimune et al. | 428/296 |
| 4,438,172 | 3/1984 | Katsaloshi et al. | 428/234 |
| 4,486,485 | 12/1984 | Sookne | 428/198 |

FOREIGN PATENT DOCUMENTS 2096048 10/1982 United Kingdom .

*Primary Examiner*—James C. Cannon

*Attorney, Agent, or Firm*—Donald M. Sell; James A. Smith; Carole Truesdale

[57] ABSTRACT

A nonwoven stretch fabric is provided. The fabric is produced from a web of bicomponent fibers bonded together by fusion of fibers at points of contact and thermally crimped in situ in the web. The fabric has good uniformity, good thermal insulating properties, and is produced by subjecting a fibrous web of thermally bondable, thermally crimpable bicomponent fibers to heated gas supplied continuously to the top of the web and intermittently to the bottom of the web.

18 Claims, 6 Drawing Figures

NONWOVEN THERMAL INSULATING STRETCH FABRIC AND METHOD FOR PRODUCING SAME

BACKGROUND OF THE INVENTION

1. Field of the Invention

The present invention relates to a nonwoven fibrous web, typically referred to herein as a "fabric", which is stretchable and is particularly useful as thermal insulation in active sportswear, such as skiwear and snowmobile suits, and in outdoor work clothes. The fabric, which comprises thermally bondable, thermally coilable bicomponent staple fibers, has low power stretch which is particularly desirable for ease and comfort during wear. The present invention also relates to a process for producing the fabric.

2. Description of the Prior Art

Nonwoven thermal insulating fabrics made of thermally bondable bicomponent fibers are known in the art. Such fabrics are described, for example, in U.S. Pat. No. 4,189,338, U.S. Pat. No. 4,068,036, U.S. Pat. No. 3,589,956 and U.K. Patent Application No. 2,096,048. However, these fabrics do not possess a useful amount of stretch, since there is insufficient springiness in the fibers between points of fiber bonding. In fact, such springiness is deliberately avoided, because the fibers used to produce such fabrics are required to have minimal latent crimp formation during thermal bonding to achieve the desired low density and/or good uniformity. Such reduction of latent crimp has been achieved by fiber stretching (U.S. Pat. No. 4,189,338), by fiber annealing (U.S. Pat. No. 3,589,956), by crimp development prior to forming the nonwoven fabric (U.S. Pat. No. 4,068,036), and by thermal conditioning of the fibers (U.K. Patent Application No. 2,096,048).

Nonwoven thermal insulating fabrics having stretch properties are also known. A non-woven thermal insulating stretch material called "Viwarm" is produced in Japan. The material is a spray-bonded, lightly needle-tacked, nonwoven web of a blend of one and three denier single component polyester fibers, the three denier fibers having sufficient crimp to provide stretch properties. However, the product possesses stretch having undesirably high power for end uses where ease and comfort is particularly desirable and does not have the desired high thermal insulating properties combined with low density desired for optimum performance characteristics. When weight is of primary consideration, as in such insulated articles as skiwear, snowmobile suits, and coats, a relatively dense, heavy product is often found unsatisfactory.

Although a nonwoven product having low-density, high thermal insulating properties and low power, comfort stretch, i.e., a fabric which is easily stretched at low force and recovers to substantially the original dimensions after removal of the force, is desirable, such a product was not available prior to the present invention.

It is, therefore, an object of the present invention to provide a nonwoven stretch fabric having excellent thermal insulating values, low density, and low power, comfort stretch suitable for use in garments.

Another object of the present invention is to provide a nonwoven stretch fabric comprised of thermally bondable, thermally crimpable bicomponent staple fibers.

A further object of the present invention is to provide a nonwoven stretch fabric having substantially uniform thickness, weight, and density.

A still further object of the present invention is to provide a process for producing a highly uniform stretch fabric having excellent thermal insulating values, low density, and low power comfort stretch.

SUMMARY OF THE INVENTION

The present invention provides a substantially uniform stretch fabric comprising a nonwoven web of bicomponent fibers bonded together by fusion of fibers at points of contact and thermally crimped in situ in the web. The fabric has excellent thermal insulating properties, low density, and low power comfort stretch with uniform thickness, weight, and density. The desired thermal crimping can be achieved with bicomponent fibers of the side-by-side type or the highly eccentric sheath/core type, and thermal bonding can be achieved by having a portion of the surface of the fiber comprised of a first component having a melting point lower than that of the second component.

The present invention also provides a process for producing the stretch fabric of the invention which comprises forming a fibrous web of thermally bondable, thermally crimpable bicomponent fibers, the fibers being substantially free of restraint to permit crimp development, and then subjecting the batt to heated gas supplied continuously to the top of the web and intermittently to the bottom of the web to cause crimping and bonding of the fibers.

DETAILED DESCRIPTION OF THE INVENTION

Figure 1:
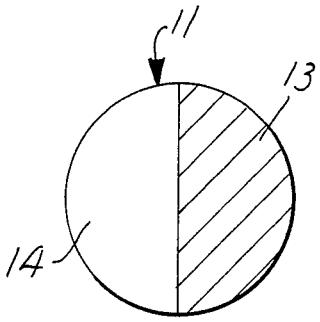
FIG. 1 is a cross-sectional view of a side-by-side bicomponent fiber useful in fabric of the present invention.
Figure 2:
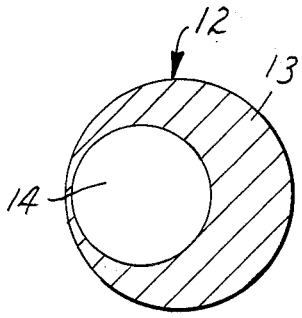
FIG. 2 is a cross-sectional view of a highly eccentric bicomponent fiber useful in fabric of the present invention.

The bicomponent fibers used in producing the fabric of the present invention must be thermally bondable and thermally crimpable. Thermally crimpable bicomponent fibers, i.e., bicomponent fibers having latent crimp developable by thermal treatment, may be side-by-side type composite fibers 11, for example, as shown in FIG. 1, or highly eccentric sheath and core type composite fibers 12, for example, as shown in FIG. 2. Although such fibers are normally round, the fiber may have other cross-sectional configurations, such as elliptical, trilobal, or even rectangular, such as are obtained from fibrillated film. The term "bicomponent fiber", as used herein, is meant to include multicomponent fibers, i.e., those fibers having two or more components. The components of the fibers must have sufficient difference in thermal stress development that when the bicomponent fiber is subjected to thermal treatment, the fibers develop three-dimensional coil-like crimps. For example, the components may be a lower melting temperature component and a higher melting temperature component.

The fibers should preferably develop an average crimp of from about 10 crimps/cm to about 100 crimps/cm, more preferably 20 to 50 crimps/cm on thermal treatment as individual fibers, for example when heated to a temperature of about 3° C. to 10° C. above the melting point temperature of the lower melting component of the fiber in an unrestrained state. The crimp formed, which may be nonuniform along the length of the fiber is of the three-dimensional coil-type with the diameter of the coil preferably in the range of from about 4–20 fiber diameters or more.

The fibers useful in the present invention must also be thermally bondable. At least a portion of the outer surface of the fiber must be comprised of a first component 13 having a melting point lower than the second component 14. The greater the portion of the outer surface comprised of the lower melting component 13, the greater the potential for bonding between fibers during thermal treatment. The lower melting component 13 preferably comprises at least 50% of the outer surface of the fiber as shown in FIG. 1. More preferably, the lower melting component 13 completely surrounds the higher melting component 14, as in the highly eccentric sheath/core type fiber shown in FIG. 2. The polymer melt temperature of the lower melting component 13 should be at least 10° C., preferably 20° C., more preferably 30° C. or more, below the polymer melt temperature of the second component 14 to facilitate processing during thermal crimping and bonding. A greater difference in polymer melt temperature between the components permits a broader range of process temperatures to be utilized.

The lower melting component of the bicomponent fiber may be selected from thermoplastic bondable polymers, such as polyolefins, polyamides and copolyamides, polyesters and copolyesters, acrylics, and the like. The higher melting component of the bicomponent fiber may be selected from fiber-forming polymers, such as polyolefins, polyamides, polyesters, acrylics, and the like. The fiber components are selected such that the thermally induced changes in dimension to achieve the previously stated crimping and polymer melting temperature differentials are satisfied. An excellent bicomponent fiber for use in the present invention is a fiber having polyethylene as the low melting component 13 and polypropylene as the high melting component 14 in the cross-sectional configuration shown in FIG. 2. Such fiber is available from Chisso Corp., Japan.

The bicomponent fibers may also be blended with conventional staple fibers, with microfibers, or with other bicomponent fibers. However, the thermally crimpable, thermally bondable bicomponent fibers must be present in sufficient amount to achieve the necessary thermal bonding and desired stretch characteristics. Generally, thermally bondable, thermally crimpable bicomponent fibers should comprise at least 50% by weight, preferably at least 75% by weight, of the fibers of the fabric to obtain desired bonding and stretch. The fabric may contain 100% bicomponent fibers.

Normally, the bicomponent fibers useful in the fabric of the present invention may have a denier within a wide range, for example, from at least as wide as 0.5 to 50 denier. When the fabric is to be used in apparel where fabric properties such as softness and drapeability are desirable, fibers of finer denier, for example, 0.5 to 5 denier, are generally preferred.

The bicomponent fibers useful for the fabric of the present invention may be in the form of staple fibers, continuous filament or tow. The fibers are preferably staple fibers, more preferably fibers of about 1.5 to 5 cm in length. Generally, the nonwoven fabric is produced from a carded or air-laid web which requires the use of staple fibers. Also, staple fibers are less restricted in such a web and have greater potential for development of latent crimp during thermal processing.

The fabric of the invention is generally about 0.4 to 2.0 cm in thickness depending on end use requirements, such as the desired degree of thermal insulation. The fabric may be even thicker where very high thermal insulation is required. The fabric thickness is measured as follows:

A 10.2 cm×15.2 cm die cut sample is subjected to a compressive force of 413.6 Pa for 30 seconds, allowed to recover for 30 seconds with the force removed, subjected to a compressive force of 87.1 Pa for 30 seconds, allowed to recover for 30 seconds with the force removed, and then measured for thickness after being subjected to a compressive force of 14.5 Pa for 30 seconds and while under such force.

The fabric weight is generally in the range of about 40 to 300 g/m$^2$.

It is usually desirable that the bulk density of the fabric be kept relatively low so as to provide high thermal insulating properties while keeping the fabric weight low. Fabric density in the range of from about 0.005 to 0.025 g/cm$^3$ is preferable for most apparel applications.

The fabric of the present invention preferably possesses a low power, comfort stretch with the force necessary to stretch the fabric 50% less than about 900 g, more preferably about 350 g to 800 g. The force to stretch is measured as follows:

A 10.2 cm×15.2 cm die cut sample, mounted in 3.8 cm wide jaws of a testing instrument such as an "Instron" tensile tester that are spaced apart a distance of 12.7 cm, is stressed to a length of 19.1 cm (50% extension), a total of 10 times. The rate of extension is 50.8 cm per minute. The force required for extension and the increase in specimen length for each extension is measured and recorded. The specimen length is also recorded after a 24 hour rest period.

The thermal insulating property of the fabric of the present invention is preferably at least about 7K.m$^2$/watt/cm, more preferably at least about 8K.m$^2$/watt/cm. Where fabric weight is an important consideration, for example, in apparel, the thermal insulating property per unit of fabric weight is preferably at least about 0.04K.m$^2$/watt/g/m$^2$. To determine the thermal insulating property a sample is tested on a guarded hot plate in the manner described in ASTM D 1518-64 with the sample subjected to a force of 14.5 Pa during the test.

Figure 4:
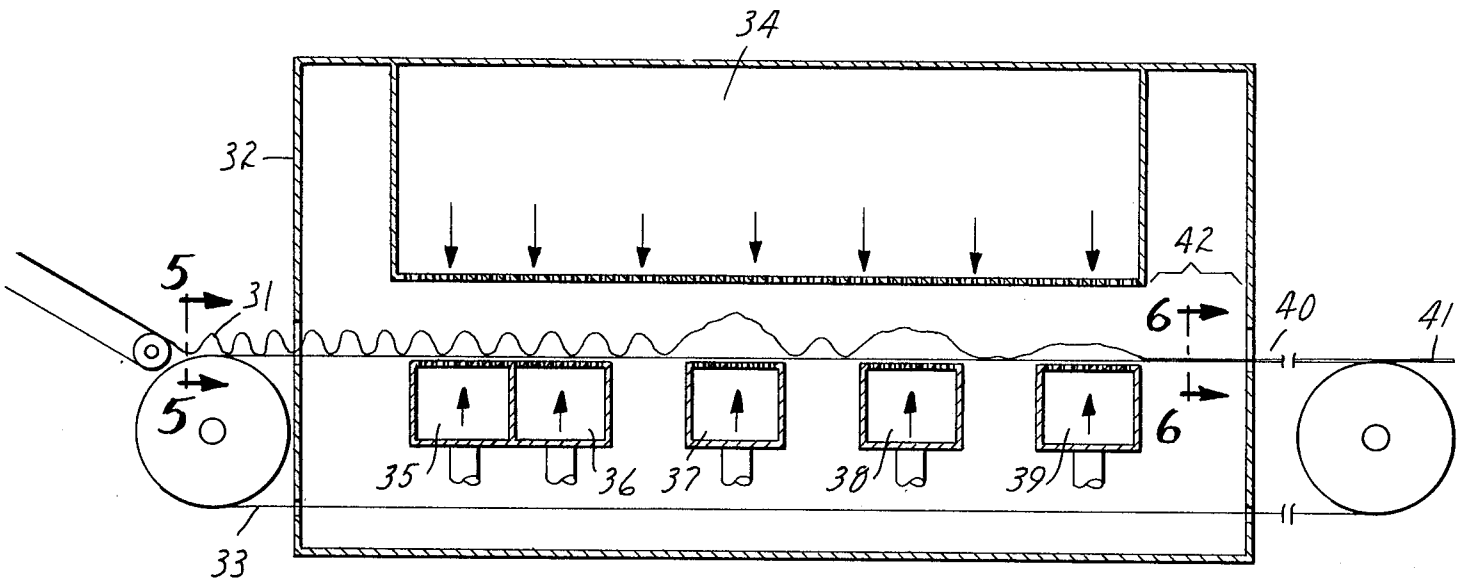
FIG. 4 is a schematic diagram of an apparatus useful for preparing fabrics of the present invention.

The preferred process for producing the nonwoven thermal insulating stretch fabric of the invention comprises forming a fibrous web of thermally bondable, thermally crimpable bicomponent fibers and then subjecting the web to heated gas supplied continuously to the top of the web and intermittently to the bottom of the web to cause crimping and bonding of the fibers. This process may be carried out using the apparatus shown in FIG. 4.

A fibrous web 31 may be formed by any known method, for example, carding, airlaying through use of apparatus such as a "Rando-Webber", or tow spreading. The fibrous web may be formed of staple fibers or continuous filament fibers. The fibrous web 31 is then fed into oven 32 where it is conveyed by porous conveyor means 33 which must be sufficiently porous to permit flow of heated gas therethrough. A useful conveyor means is galvanized window screen. The fibrous web should be fed into oven 32 with sufficient overfeed to permit the fibers in the web to coil during crimp development. Generally, the overfeed may be in the range of from about 30% to 100%, preferably about 50%.

The fibrous web 31 is passed through a preheat oven portion where the web is subjected to hot air directed from top plenum 34 and bottom plenums 35 and 36. The distance between the lower surface of top plenum 34 and conveyor means 33 is dependent upon the height to which the fibrous web 31 is raised by the hot air from the bottom plenums and the pressure of the air directed from the top plenum. Sufficient clearance is provided so that movement of the fibrous web by the conveyor is not hindered by contact with the top plenum. However, the top plenum should be sufficiently close to the fibrous web to provide an effective amount of hot air to cause crimp development and thermal bonding. The temperature of the hot air directed from top plenum 34 and bottom plenums 35 and 36 should be higher than the melting temperature of the low melting constituent of the bicomponent fiber and lower than the melting temperature of the high melting constituent of the fiber. The temperature of the hot air used throughout oven 32 may be the same.

The fibrous web is then carried through a portion of the oven where hot air is provided only from top plenum 34. Then, the fibrous web is subjected to hot air provided from both top plenum 34 and bottom plenum 37. The force of the hot air provided by bottom plenum 37 is sufficient to raise the fibrous web 31 from the conveyor such that the web is unrestrained and the fibers of the web are free to develop the inherent latent crimp. The low melting constituent of the fiber is also softening at this time to permit bonding between the fibers. The fibrous web again passes through a portion of the oven where it is conveyed by conveyor means 33 with hot air provided only by upper plenum 34. Then, the fibrous web is again subjected to hot air from both top plenum 34 and bottom plenum 38, with the force of the air provided by bottom plenum 38 sufficient to again raise the web from the surface of conveyor means 33 such that the web is unrestrained and the fibers are permitted to freely crimp.

The fibrous web 31 can then again be passed through a portion of the oven where it is conveyed by conveyor means 33 with hot air provided only by upper plenum 34 and then again through a portion where hot air is provided from both top plenum 34 and bottom plenum 39 with the force of the air provided by bottom plenum 39 sufficient to raise the web from the surface of conveyor means 33. The number of cycles of heating, in which the hot air is provided only from the top plenum and then from both the top and bottom plenums, can vary depending on such factors as, for example, conveyor speed, web density, and thickness. The web may then pass through a portion 42 of the oven where it is conveyed by conveyor means 33 with hot air provided by only the top plenum to effect further fiber bonding.

The web, in which the fibers have sufficiently developed crimp and the lower melting constituent has softened sufficiently to permit bonding, is then conveyed through cooling portion 40 where bonds between the fibers develop. The cooled stretch fabric 41 of thermally bonded, crimped fiber is then typically wound into a storage roll.

Figure 3:
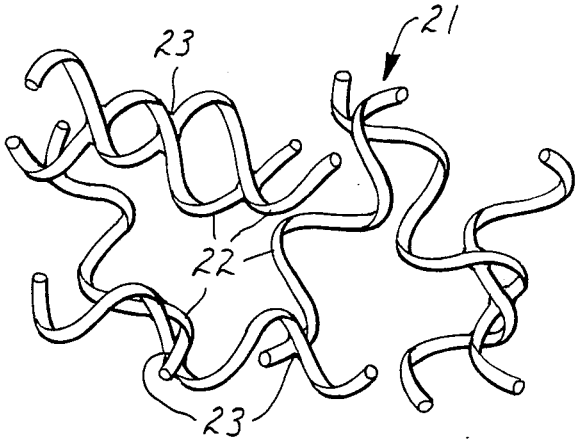
FIG. 3 is a greatly enlarged sectional view of a portion of a sheet product of the present invention.
Figure 6:
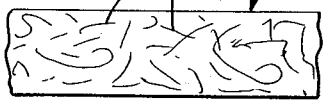
FIG. 6 is a cross-sectional view of a portion of the fabric of the invention taken at 6—6 of FIG. 4.
Figure 5:
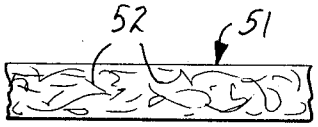
FIG. 5 is a cross-sectional view of a portion of the unbonded fibrous web taken at 5—5 of FIG. 4 for use in the present invention.

An unbonded fibrous web 51 of bicomponent fibers 52 prior to thermal treatment is shown in FIG. 5. After thermal treatment, as shown in FIG. 6, the bonded fibrous web 61 of thermally crimped, thermally bonded bicomponent fibers 62 shows a marked increase in thickness. The thickness of the fabric may more than double during thermal treatment. In FIG. 3, a greatly enlarged view of a portion of the bonded web shown in FIG. 6, bonded contact points 23 between fibers 22 of web 21 are more clearly visible.

It is believed that the combination of thermal crimping and thermal bonding of the fibers in the fabric produced during thermal treatment contribute to producing the desired stretch characteristics of the fabric. Generally, both the amount of crimp developed and the degree of interfiber bonding increase as the thermal treatment temperature increases above the melting point temperature of the lower melting point temperature component. If the thermal treatment temperature is too low, insufficient crimping and bonding will occur. If the thermal treatment temperature is too high, excessive thermal bonding and thermal crimping will occur, resulting in a fabric requiring a relatively high degree of force to stretch. Generally, an indicated treatment temperature from about 3° C. to 10° C., more preferably 4° C. to 6° C., above the melting point temperature of the lower melting point temperature fiber component will produce the desired balance of stretch properties desired for use in apparel.

It is further believed that the excellent uniformity of the fabric of the present invention is achieved by the use of the alternating restricted and unrestricted condition which occurs as the fiber web is intermittently subjected to heated air from below the web. The fiber web is restricted from shrinking while on the conveyor. The fiber web is substantially unrestricted when it is raised above the conveyor by the force of the air stream directed from the lower plenum.

Crosslapping of the fiber web either before or after the thermal treatment may also be carried out. The fiber web may be crosslapped prior to the thermal treatment to increase the thickness and/or width of the fiber web and to provide a bias structure to the fiber web. This has been found to be particularly useful where the fibrous web has been formed by carding. The thermal treatment is carried out in the same manner as for a non-crosslapped fibrous web. The fibrous web may also be crosslapped subsequent to the thermal treatment to provide increased thickness and/or width of the final fabric and to provide a bias structure to the fabric. After crosslapping, the fibrous web is subjected to thermal treatment to bond the crosslapped layers together. Usually, little thermal shrinkage of the fibers and web occurs during this second thermal treatment since the crosslapped web is generally in an essentially restricted condition on a conveyor. The temperature at which the crosslapped layers are bonded should be high enough to cause bonding, but not so high as to substantially affect the stretch properties of the fabric.

The invention will be further illustrated by the following examples:

EXAMPLE 1

An air-laid fibrous web is formed from opened bicomponent polyethylene/polypropylene fibers ("Chisso" ES fibers, available from Chisso Corp., Osaka, Japan) of 1.5 denier per filament and 38 mm cut length in the conventional manner. The web is conveyed, at 370 cm per minute, by a wood slat conveyor to an oven, similar to that shown in FIG. 4, having a galvanized window screen oven conveyor whose velocity is 240 cm per minute. The web formed a sinusoidal shape on the screen conveyor and was conveyed into an air-heated oven whose indicated air temperature was 138.9° C. Air was directed from both above from a top plenum and below from bottom plenum chambers 35 and 36 onto the fibrous web. The air plenum chambers in both the bottom and top portions of the oven were constructed of a thin flat steel plate having 0.318 cm diameter circular holes staggered on 1.25 cm centers. After a traveling distance of about 66 cm in the oven, the web was gently raised to a height of about 5 to 8 cm above the screen by the force of the hot air from beneath the web provided by plenum chamber 37. After traveling a distance of about 23 cm, the force of the air from beneath was reduced and the web was returned to the conveyor for a distance of about 13 cm. This process was repeated two more times with the web being raised by the hot air provided by plenum chambers 38 and 39 as the conveyor moved through the oven. The web was then conveyed by the screen through the oven for a distance of about 280 cm and then emerged from the oven. The web remained on the screen for a distance of about 100 cm to allow cooling. The resulting fabric was then removed from the screen and wound with slight tension onto a take-up tube. The thermal bonded fabric was extremely uniform in width, thickness, and density and had increased basis weight, thickness, and bulk density as is illustrated by the following data (Table 1).

TABLE 1

| | Mean Value | Standard Deviation | Coefficient of variation % |
|---|---|---|---|
| Unbonded batt | | | |
| Weight (g/m$^2$) | 26.9 | 0.52 | 1.9 |
| Thickness (cm) | 0.42 | 0.01 | 2.5 |
| Bulk density (g/cm$^3$) | 0.0065 | 0.00017 | 2.6 |
| Thermally bonded fabric | | | |
| Weight (g/m$^2$) | 77.8 | 2.55 | 3.3 |
| Thickness (cm) | 0.67 | 0.015 | 2.2 |
| Bulk density (g/cm$^3$) | 0.0116 | 0.0003 | 2.9 |

EXAMPLES 2–10

Examples 2 through 10 were processed in the following manner with the specific process conditions, fiber compositions, and web weights detailed in Table 2 which follows. The bicomponent fibers used were "Chisso ES" fibers, 38 mm in length, with denier as indicated in Table 2, and the polyester fibers used were 1.75 denier, 38 mm staple fibers.

An air-laid fibrous web, formed in the conventional air-laid manner from the fiber compositions set forth in Table 2, is conveyed, at 450 cm per minute, by a wood slat conveyor to a galvanized window screen oven conveyor, whose velocity is 300 cm per minute. The web formed a sinusoidal shape on the screen conveyor and was conveyed into a heated air oven. The indicated temperature of the heated air and the plenum pressure for each example is set forth in Table 2. Air was directed from both above and below into the fiber web. After traveling a distance of about 150 cm into the oven, the web was gently raised to a height of about 7.5 to 10 cm above the screen by the force of the air beneath the web. After traveling a distance of about 25 cm, the force of the air was reduced and the web returned to the conveyor for a distance of about 7.5 cm; the force of the air was then increased beneath the web and the web gently rose to a height of about 2.5 to 5 cm above the conveyor and traveled for a distance of about 20 cm; the force of the air was then reduced and the web returned to the conveyor for a distance of about 12 cm and again the force of the air was increased and the web gently rose to a modest height above the conveyor where it traveled for a distance of about 20 cm; once again it was returned to the conveyor and was conveyed through the oven for a distance of about 280 cm and then emerged from the oven. The web remained on the conveying screen for a distance of about 100 cm to allow cooling. It was then removed from the screen and wound with slight tension and compression onto a paper tube.

These examples demonstrate the effect of varying the properties of the input unbonded web and the process conditions. The properties of the resulting fabrics are set forth in Table 3.

The examples demonstrate the excellent thermal insulating properties and stretch characteristics of the fabric of the invention. In Examples 2, 3 and 4, similar unbonded webs were passed through the oven with the plenum pressure the same for each example, but with varying process temperatures. The resulting fabrics, as shown by the data in Table 3, increase in basis weight, thickness, force required to stretch and thermal resistance with increased processing temperature. Examples 5 and 6 demonstrate the effect of using a higher basis weight unbonded web than in Examples 2, 3 and 4 at different processing temperatures. The higher oven temperature resulted in a bonded web which reguired more force to stretch. Examples 7 and 8 demonstrate the effect of combining conventional polyester staple fibers with bicomponent fibers. Although the basis weight and bulk density did not increase during processing of the web through the oven as much as when only bicomponent fibers were used, an increase in thickness was observed and the bonded webs had excellent thermal insulating properties and low force to stretch. Example 9 illustrates the effect of using a finer denier bicomponent fiber to form the web. Although a low oven temperature and low plenum pressure were used, the resulting fabric required more force to stretch than when a similar unbonded web of heavier denier fiber was processed at the same temperature using higher plenum pressure (Example 2). Example 10 further demonstrates that lower oven temperature results in a bonded web requiring low force to stretch.

TABLE 2

| | Example | | | | | | | | |
|---|---|---|---|---|---|---|---|---|---|
| | 2 | 3 | 4 | 5 | 6 | 7 | 8 | 9 | 10 |
| Unbonded Web Properties | | | | | | | | | |
| Fiber content (%) | | | | | | | | | |

TABLE 2-continued

| | Example | | | | | | | | |
|---|---|---|---|---|---|---|---|---|---|
| | 2 | 3 | 4 | 5 | 6 | 7 | 8 | 9 | 10 |
| Bicomponent | 100 | 100 | 100 | 100 | 100 | 75 | 87 | 100 | 100 |
| Polyester | 0 | 0 | 0 | 0 | 0 | 25 | 13 | 0 | 0 |
| Mean fiber density | 0.915 | 0.915 | 0.915 | 0.915 | 0.915 | 1.031 | 0.975 | 0.915 | 0.915 |
| Fiber denier | | | | | | | | | |
| Bicomponent | 1.5 | 1.5 | 1.5 | 1.5 | 1.5 | 1.5 | 1.5 | 0.9 | 1.5 |
| Polyester | — | — | — | — | — | 1.75 | 1.75 | — | — |
| Basis weight (g/m$^2$) | 26.7 | 23.7 | 24.3 | 38.8 | 34.5 | 33.6 | 31.8 | 29.6 | 29.1 |
| Thickness (cm) | 0.22 | 0.22 | 0.24 | 0.32 | 0.30 | 0.42 | 0.43 | 0.32 | 0.29 |
| Bulk density (g/cm$^3$) | 0.012 | 0.011 | 0.010 | 0.012 | 0.011 | 0.008 | 0.007 | 0.009 | 0.009 |
| Packing factor | 0.013 | 0.012 | 0.011 | 0.013 | 0.013 | 0.008 | 0.008 | 0.010 | 0.010 |
| Process Conditions | | | | | | | | | |
| Temperature (°C.) | 135.0 | 136.1 | 137.2 | 135.0 | 137.2 | 137.2 | 137.2 | 135.0 | 133.9 |
| Top plenum pressure (cm water) | 0.13 | 0.13 | 0.13 | 0.13 | 0.13 | 0.13 | 0.13 | 0.13 | 0.13 |
| Bottom plenum pressure (cm water) | | | | | | | | | |
| Chamber 35 | 0.13 | 0.13 | 0.13 | 0.15 | 0.15 | 0.08 | 0.08 | 0.08 | 0.13 |
| Chamber 36 | 0.05 | 0.05 | 0.05 | 0.08 | 0.08 | 0.03 | 0.03 | 0.03 | 0.05 |
| Chamber 37 | 0.18 | 0.18 | 0.18 | 0.23 | 0.23 | 0.17 | 0.17 | 0.17 | 0.18 |
| Chamber 38 | 0.22 | 0.22 | 0.22 | 0.22 | 0.28 | 0.19 | 0.19 | 0.19 | 0.22 |
| Chamber 39 | 0.05 | 0.05 | 0.05 | 0.05 | 0.10 | 0.05 | 0.05 | 0.05 | 0.05 |

TABLE 3

| | Example | | | | | | | | |
|---|---|---|---|---|---|---|---|---|---|
| | 2 | 3 | 4 | 5 | 6 | 7 | 8 | 9 | 10 |
| Bonded Web Properties | | | | | | | | | |
| Basis weight (g/m$^2$) | 87.8 | 98.5 | 104.4 | 129.8 | 129.8 | 75.0 | 69.7 | 80.0 | 87.2 |
| Thickness (cm) | 0.46 | 0.50 | 0.55 | 0.73 | 0.68 | 0.86 | 0.97 | 0.47 | 0.48 |
| Bulk density (g/cm$^3$) | 0.019 | 0.020 | 0.019 | 0.018 | 0.019 | 0.009 | 0.007 | 0.017 | 0.018 |
| Packing factor | 0.021 | 0.022 | 0.021 | 0.020 | 0.021 | 0.008 | 0.007 | 0.019 | 0.020 |
| Force to stretch 50% | | | | | | | | | |
| Cycle 1 (g) | 205 | 401 | 723 | 140 | 512 | 677 | 418 | 697 | 118 |
| Cycle 10 (g) | 162 | 314 | 544 | 115 | 406 | 517 | 324 | 493 | 89 |
| Growth in length | | | | | | | | | |
| Cycle 4 (%) | 14 | 14 | 14 | 13 | 13 | 13 | 13 | 14 | 13 |
| Cycle 10 (%) | 16 | 16 | 18 | 16 | 15 | 17 | 17 | 17 | 15 |
| 24 hr. rest (%) | 5 | 5 | 5 | 3 | 5 | 5 | 5 | 4 | 2 |
| Thermal Resistance | | | | | | | | | |
| K · m$^2$/watt | 4.64 | 5.52 | 5.63 | 7.59 | 6.92 | 8.77 | 8.06 | 4.65 | 5.48 |
| K · m$^2$/watt per cm thickness | 9.11 | 10.41 | 9.39 | 9.37 | 9.67 | 10.20 | 8.31 | 9.89 | 9.79 |
| K · m$^2$/watt per basis weight | 0.048 | 0.053 | 0.050 | 0.063 | 0.057 | 0.117 | 0.116 | 0.058 | 0.063 |

What is claimed is:

1. A substantially uniform stretch fabric comprising a nonwoven web of bicomponent fibers bonded together by fusion of fibers at points of contact and thermally crimped in situ in the web.

2. The fabric of claim 1 wherein said fabric is thermal insulating.

3. The fabric of claim 2 wherein the thermal insulating property of the fabric is at least about 7K.m$^2$/watt/g/m$^2$.

4. The fabric of claim 1 wherein the force necessary to stretch the fabric to 50% extension is less than about 900 g.

5. The fabric of claim 1 wherein the bicomponent fiber components are in a side-by-side configuration.

6. The fabric of claim 1 wherein the bicomponent fiber components are in an eccentric sheath/core configuration.

7. The fabric of claim 1 wherein the bicomponent fibers comprise a first component and a second component, the first component having a melting point temperature at least 10° C. greater than the melting point temperature of the second component and the second component comprising at least 50% of the outer surface of the fiber.

8. The fabric of claim 7 wherein the bicomponent fibers are capable of developing from about 10 crimps/cm to about 100 crimps/cm on thermal treatment when heated as individual fibers in an unrestrained state to a temperature of about 3° C. to 10° C. above the melting point temperature of the lower melting component of the fiber.

9. The fabric of claim 1 wherein the fabric thickness is about 0.4 to 2.0 cm.

10. The fabric of claim 1 wherein the fabric weight is about 40 to 300 g/m$^2$.

11. The fabric of claim 1 wherein the bulk density of the fabric is about 0.005 to 0.025 g/cm$^3$.

12. The fabric of claim 1 further comprising monocomponent staple fibers.

13. The fabric of claim 12 wherein said staple fibers are polyester.

14. The fabric of claim 1 wherein said fabric is repeatedly stretchable to an amount at least 50% above the original fabric length.

15. A process for producing a substantially uniform stretch fabric comprising forming a fibrous web of thermally bondable, thermally crimpable bicomponent fibers and then subjecting the web to heated gas supplied continuously to the top of the web and intermittently to the bottom of the web to cause crimping and bonding of the fibers.

16. The process of claim 15 wherein the web is in a substantially completely unrestrained state when heated gas is supplied to both the top and bottom of the web.

17. The process of claim 15 wherein said bicomponent fibers comprise a first component and a second component, the first component having a melting point temperature at least 10° C. greater than the melting point temperature of the second component and the component comprising at least 50% of the outer surface of the fiber.

18. The process of claim 17 wherein said bicomponent fibers are capable of developing from about 10 crimps/cm to about 100 crimps/cm when, in an unrestrained state as individual fibers, said fibers are treated with heated gas at a temperature of about 3° C. to 10° C. above the melting point of the lower melting component of the fiber.

* * * * *